US008864220B2

(12) United States Patent
Kim

(10) Patent No.: US 8,864,220 B2
(45) Date of Patent: Oct. 21, 2014

(54) MULTIFUNCTIONAL CHAIR

(76) Inventor: Han Joo Kim, Busan (KR)

( * ) Notice: Subject to any disclaimer, the term of this patent is extended or adjusted under 35 U.S.C. 154(b) by 17 days.

(21) Appl. No.: 13/882,756

(22) PCT Filed: Nov. 4, 2011

(86) PCT No.: PCT/KR2011/008371

§ 371 (c)(1),
(2), (4) Date: May 1, 2013

(87) PCT Pub. No.: WO2012/060658

PCT Pub. Date: May 10, 2012

(65) Prior Publication Data

US 2013/0328360 A1 Dec. 12, 2013

(30) Foreign Application Priority Data

Nov. 5, 2010 (KR) ..... 10-2010-0109534
Nov. 3, 2011 (KR) ..... 10-2011-0113961

(51) Int. Cl.

| | |
|---|---|
| ***A47C 4/30*** | (2006.01) |
| ***A47C 20/04*** | (2006.01) |
| ***A47C 7/50*** | (2006.01) |
| ***A47C 1/032*** | (2006.01) |
| ***A47C 1/034*** | (2006.01) |
| *A61G 5/14* | (2006.01) |

(52) U.S. Cl.

CPC . *A47C 1/032* (2013.01); *A61G 5/14* (2013.01); *A47C 1/0342* (2013.01)

USPC ..... 297/19; 297/21; 297/27; 297/30; 297/38; 297/39; 297/423.26; 297/423.3

(58) Field of Classification Search

USPC ..... 297/16.2, 18, 19, 21, 27, 30, 38, 39, 297/423.26, 423.3

See application file for complete search history.

(56) References Cited

U.S. PATENT DOCUMENTS 2,099,460 A * 11/1937 Bell ..... 297/365
2,571,463 A * 10/1951 Lorenz ..... 297/29

(Continued)

FOREIGN PATENT DOCUMENTS

DE 1554150 11/1969
FR 1417356 11/1965

(Continued)

OTHER PUBLICATIONS

International Search Report—PCT/KR2011/008371 dated Jun. 28, 2012.

European Search Report-European Application No. EP 11 83 8263 issued on Feb. 11, 2014, citing FR 1 417 356, US 6 692 068, DE 15 54 150 and GB 611 832.

* cited by examiner

*Primary Examiner* — Rodney B White
(74) *Attorney, Agent, or Firm* — Cantor Colburn LLP

(57) ABSTRACT

A chair according to an embodiment of the present invention includes a seat frame, a plurality of legs, a backrest and an armrest. The plurality of legs are rotatably coupled to the seat frame at front and rear portions of the seat frame. The backrest is rotatably coupled to the seat frame at the rear portion of the seat frame. The armrest is rotatably coupled to upper ends of the legs. The armrest includes a movable member and a first elastic member. The movable member is retained inside the armrest and is movable along the armrest. The movable member is rotatably coupled to the backrest. The first elastic member is located inside the armrest and applies an elastic restoration force against the movement of the movable member.

12 Claims, 10 Drawing Sheets

(56) References Cited

U.S. PATENT DOCUMENTS

| | | | | |
|---|---|---|---|---|
| 2,675,059 | A * | 4/1954 | Martin | 297/18 |
| 4,072,341 | A * | 2/1978 | Kurz | 297/27 |
| 4,603,902 | A | 8/1986 | Maloney | |
| 6,030,032 | A * | 2/2000 | Tseng | 297/38 |
| 6,692,068 | B1 | 2/2004 | Tang | |
| 6,902,231 | B1 * | 6/2005 | Tseng | 297/27 |
| 7,628,450 | B2 * | 12/2009 | Castagnola et al. | 297/38 |
| 7,950,734 | B2 * | 5/2011 | Zheng | 297/27 X |
| 2002/0121800 | A1 * | 9/2002 | Yu | 297/27 |

FOREIGN PATENT DOCUMENTS

| | | |
|---|---|---|
| GB | 611832 | 11/1948 |
| KR | 19850005767 | 9/1985 |
| KR | 200224270 | 3/2001 |
| KR | 200321056 | 7/2003 |
| KR | 200355128 | 6/2004 |

MULTIFUNCTIONAL CHAIR

TECHNICAL FIELD

The present invention relates to a chair, and more particularly to a chair which is transformable in response to the shift of the center of gravity of a user's upper body.

BACKGROUND

A chair includes a seat, a backrest and legs supporting the backrest and the seat. To relieve the user's fatigue and comfortably support the user even during extended periods of sitting, numerous studies have been made on chairs having multi-functions.

As an example of a multifunctional chair, Korean Utility Model Registration Publication No. 20-0355128 discloses a chair with a backrest which is tillable in a backward direction at a predetermined angle.

The prior art multifunctional chair, however, only provides the backward-tiltablity function of the backrest. The prior art multifunctional chair is not adaptable to the change in the user's postures, such as leaning back or standing up of the user sitting on the chair.

SUMMARY

The present invention is directed to solving the aforementioned problems. It is an object of the present invention to provide a chair which is transformable in response to the shift of a center of gravity of a sitting user.

A chair according to an embodiment of the present invention comprises a seat frame, a plurality of legs, a backrest and an armrest. The plurality of legs are rotatably coupled to the seat frame at a front portion and a rear portion of the seat frame. The backrest is rotatably coupled to the seat frame at the rear portion of the seat frame. The armrest is rotatably coupled to upper ends of the legs, and includes a movable member and a first elastic member. The movable member is retained inside the armrest and is movable along the armrest. The movable member is also rotatably coupled to the backrest. The first elastic member is located inside the armrest and applies an elastic restoration force against a movement of the movable member.

The movable member includes a first guide slot formed in the movable member. The plurality of legs may comprise: a front leg rotatably coupled to the seat frame and the armrest; a rear leg rotatably coupled to the armrest; an auxiliary front leg rotatably coupled to the seat frame and rotatably coupled to the first guide slot at its upper end; and an auxiliary rear leg rotatably coupled to the rear leg and rotatably coupled to the front leg at its front end.

The plurality of legs may further comprise: a first slide member rotatably coupled to the auxiliary front leg, and backward- and forward-movably coupled to the seat frame along the seat frame; and a second slide member rotatably coupled to the auxiliary rear leg, and backward- and forward-movably coupled to the auxiliary rear leg along the auxiliary rear leg.

The chair may further comprise a seat frame drive device having a second elastic member. The seat frame drive device is elastically connected to the armrest via the second elastic member and rotates the seat frame with respect to the plurality of legs.

The seat frame further includes a second, circular arc-shaped guide slot at its top. The seat frame drive device includes: a first shaft coupled to a lateral portion of the seat frame drive device at its one end; a link member coupled to the opposite end of the first shaft at its one end; and a second shaft coupled to the opposite end of the link member at its one end. The opposite end of the second shaft moves along the second guide slot.

The seat frame drive device includes a second screw and a first nut coupled to the second screw in thread engagement therewith. The second elastic member is connected to the first nut at its opposite end.

The seat frame comprises: a support pin; a first seat frame rotatably coupled to the front leg via the support pin; and a second seat frame rotatably coupled to the front leg via the support pin. The second seat frame rotates around the support pin relative to the first seat frame.

The movable member includes: a first screw; and a rod coupled to the first screw in thread engagement therewith and connected to the first elastic member. The rotation of the first screw moves the rod with screw motion.

The auxiliary front leg includes: an auxiliary seat disposed rotatably with respect to the auxiliary front leg; and an elevation device elevating and lowering the auxiliary seat.

The elevation device includes: a threaded shaft; a second nut, which is coupled in thread engagement with the threaded shaft at either side of the auxiliary seat and is moved with screw motion along the threaded shaft; a drive shaft disposed perpendicularly to the threaded shaft at a lower portion of the auxiliary front leg; and a worm wheel and a worm gear disposed between the threaded shaft and the drive shaft and being in mesh with each other.

The elevation device includes a handle coupled to an end of the drive shaft via a ratchet mechanism.

The auxiliary front leg further includes an auxiliary handle which is rotatably coupled to the lower portion of the auxiliary front leg at its one end and is releasably coupled to a lower portion of the handle at its opposite end.

The chair according to one embodiment of the present invention is capable of easily and stably tilting back or returning to an initial state without particular manipulation in response to the shift of a center of gravity of the user's upper body. The auxiliary front leg supports the user's calves or legs merely by the user pivoting the auxiliary front leg while sitting on the chair. Further, the chair has an erection function that assists the user, such as a patient or a disabled person, to stand up. Furthermore, due to elevation device of the auxiliary front leg, which elevates and lowers the auxiliary seat, the user (e.g., patients having unsound legs) can easily sit on the seat frame from the floor.

DETAILED DESCRIPTION

Descriptions are made below as to embodiments of a chair according to the present invention with reference to the accompanying drawings.

A chair according to an embodiment of the present invention may be used in three states. In a first state (see FIGS. 1 and 8), a backrest of the chair is positioned nearly vertically to the floor. In a second state (see FIG. 9), the backrest of the chair is positioned such that it is tilted in a backward direction from the first state. In a third state (see FIG. 10), the backrest of the chair is positioned such that it is moved in an upward and forward direction from the first state.

Figure 1:
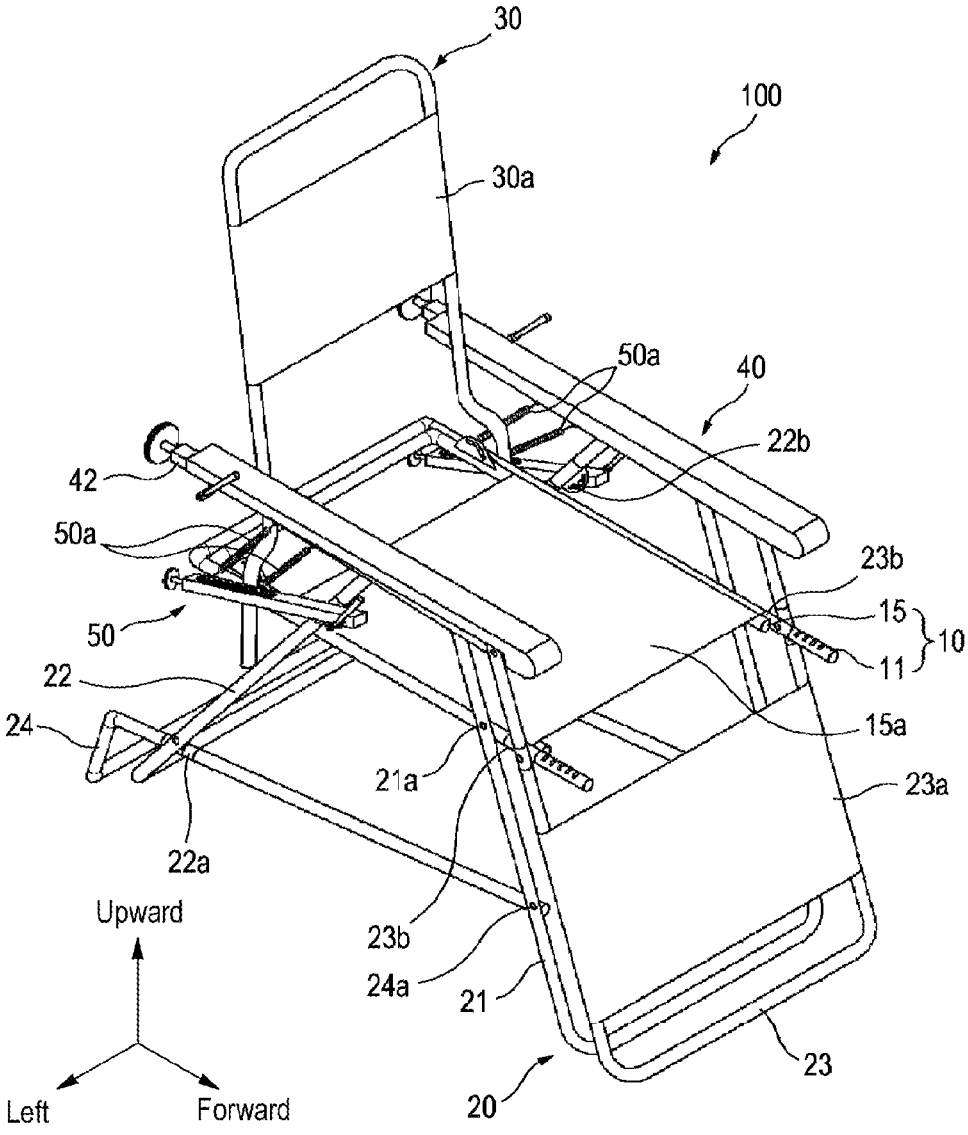
FIG. 1 is a perspective view showing a chair according to one embodiment of the present invention.

Referring to FIG. 1, the chair 100 according to an embodiment of the present invention includes a seat frame 10, legs 20, a backrest 30, armrests 40 and seat frame drive devices 50.

As shown in FIG. 1, the seat frame 10 includes a first seat frame 11 and a second seat frame 15. The first and second seat frames 11, 15 may have an inverse U-shape when viewed from the top. The second seat frame 15 is situated inside the first seat frame 11. The first and second seat frames 11, 15 are rotatable around a first support pin 21*a* relative to each other. A cushion member (or a fabric member) 15*a* for supporting the user is coupled to the second seat frame 15. The seat frame 10 may comprise a hollow tubular member or solid rod member, which may have various cross sectional shapes. The seat frame 10 may be made of a metallic or plastic material. Where the seat frame 10 does not include the second seat frame 15, the cushion member 15*a* may be coupled to the first seat frame 11.

The legs 20 include a front leg 21, a rear leg 22, an auxiliary front leg 23 and an auxiliary rear leg 24. The front leg 21, the rear leg 22 and the auxiliary front leg 23 may have a U-shape. The legs 20 may comprise a hollow tubular member or solid rod member, which may have various cross sectional shapes, and may be made of a metallic or plastic material. The chair 100 may further include casters or wheels at the lower portions of the legs 20 for movement of the chair.

The front leg 21 supports the seat frame 10 and the armrest 40. The front leg 21 is rotatably hinge-joined to a front portion of each armrest 40 at either of its upper ends. The first and second seat frames 11, 15 are rotatably joined to an upper portion of the front leg 21 via the first support pin 21*a*.

The rear leg 22 supports the armrest 40. The rear leg 22 is rotatably hinge-joined to an approximately middle portion of each armrest 40 at either of its upper ends. The rear leg 22 is joined to the auxiliary rear leg 24 via a second slide member 22*a*. The second slide member 22*a* may have a hollow cylindrical shape. The second slide member 22*a* is rotatably coupled to a lower portion of the rear leg 22. Further, the second slide member 22*a* is slidably coupled to the auxiliary rear leg 24 to be slidable in both backward and forward directions along the auxiliary rear leg 24. Thus, the lower portion of the rear leg 22 is rotatable with respect to the auxiliary rear leg 24 and is movable in both backward and forward directions along the auxiliary rear leg 24. Another embodiment may include the second slide member 22*a* fixed to the auxiliary rear leg 24 at any position. For example, the second slide member 22*a* may have a protrusion protruding inwardly with resilience and the auxiliary rear leg 24 may have a plurality of recesses which said protrusion engages.

The auxiliary front leg 23 supports the user's legs or calves in the first or second state. To support the user's legs in the second sate, a cushion member (or a fabric member) 23*a* is coupled to the auxiliary front leg 23. The auxiliary front leg 23 is joined to the first seat frame 11 via a first slide member 23*b*. The first slide member 23*b* may have a hollow cylindrical shape, and is rotatably coupled to an upper portion of the auxiliary front leg 23. Further, the first slide member 23*b* is slidably coupled to a front portion of the first seat frame 11 to be slidable in both backward and forward directions along the first seat frame 11. Thus, the upper portion of the auxiliary front leg 23 is rotatable with respect to the first seat frame 11 and is movable in both backward and forward directions along the first seat frame 11. Another embodiment may include the first slide member 23*b* fixed to the front portion of the first seat frame 11 at any position. For example, the first slide member 23*b* may have a protrusion protruding inwardly with resilience and the first seat frame 11 may have a plurality of recesses which said protrusion engages.

The auxiliary rear leg 24 is joined to an approximately middle portion of the front leg 21 via a second support pin 24*a* at its two front ends. Thus, the auxiliary rear leg 24 is rotatable with respect to the front leg 21 around the second support pin 24*a*. As described above, the auxiliary rear leg 24 is joined to the rear leg 22 via the second slide member 22*a*.

The backrest 30 supports the user's back, and may have an inverse U-shape. Two lower ends of the backrest 30 extend outward. As shown in FIG. 1, the backrest 30 is rotatably coupled to the armrest 40 via a rotating shaft 45*b* at its approximately middle portion. At lower portions of the backrest 30, the backrest 30 is rotatably coupled to both the first seat frame 11 and the seat frame drive device 50 via a first shaft 55 that will be described below.

The backrest 30 may comprise a hollow tubular member or solid rod member, which may have various cross sectional shapes. The backrest 30 may be made of a metallic or plastic material.

Figure 2:
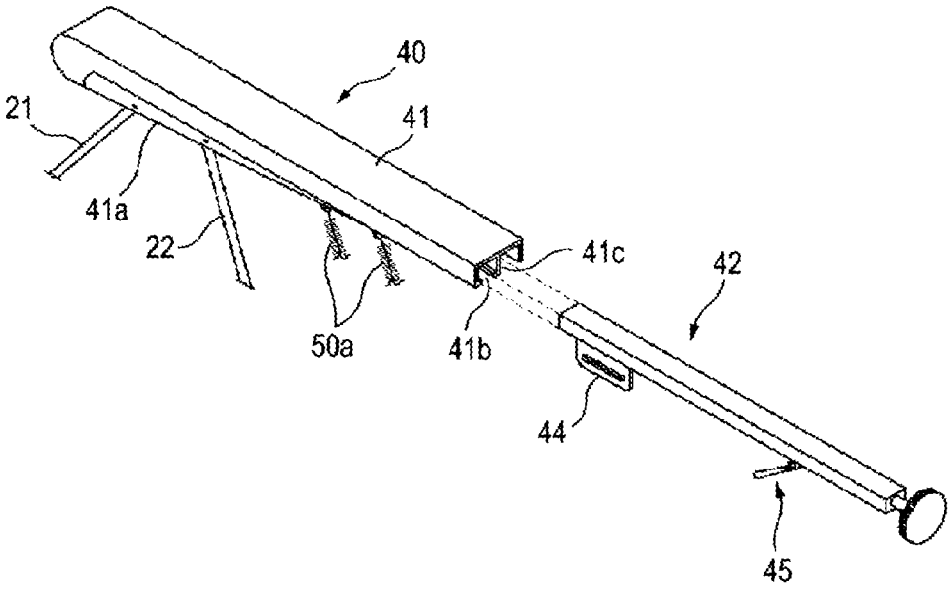
FIG. 2 is an exploded perspective view showing an armrest shown in FIG. 1.
Figure 3:
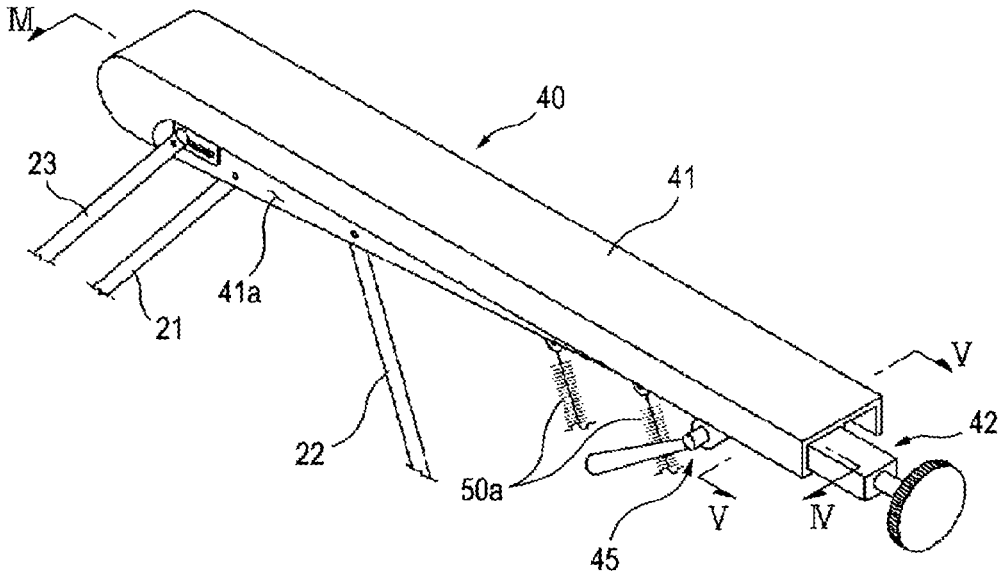
FIG. 3 is a perspective view showing an armrest shown in FIG. 1.
Figure 4:
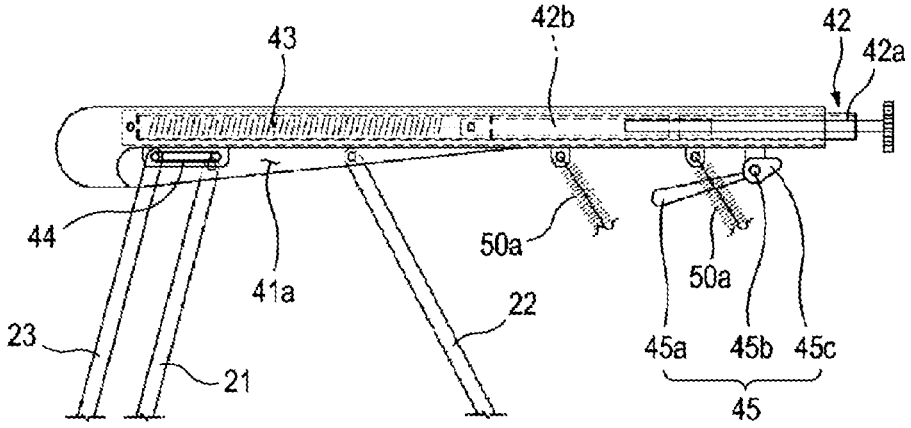
FIG. 4 is a sectional view taken along the line IV-IV of FIG. 3.

Referring to FIGS. 2 to 4, the armrest 40 includes an armrest body 41, a movable member 42 and a first elastic member 43.

The armrest body 41 includes a recess 41*a*, a first rail groove 41*b* and a second rail groove 41*c*. The recess 41*a* is recessed inwardly from a lateral surface of the armrest body 41. The first rail groove 41*b* guides the movable member 42 which is received in the first rail groove 41*b*. The upper ends of the front leg 21 and the upper ends of the rear leg 22 are hinge-joined to the second rail groove 41*c*. As shown in FIG. 2, the first and second rail grooves 41*b*, 41*c* are formed in juxtaposition. The first rail groove 41*b* may have a C-shaped cross section and the second rail groove 41*c* may have an inverse U-shaped cross section.

The movable member 42 is received in the first rail groove 41*b* and is movable along the first rail groove 41*b*. As shown in FIG. 4, the movable member 42 includes a first screw 42*a* and a rod 42*b*. A portion of the first screw 42*a* is exposed outwardly from a rear end of the movable member 42, while the rest of the first screw 42*a* is received inside the movable member. The movable member is configured such that the first screw 42*a* is rotatable in its position. The rod 42*b* is received inside the movable member 42. The rod 42*b*, at its one end portion, receives the first screw 42*a* and the first screw 42*a* is coupled to the rod 42*b* in thread engagement therewith. Further, the rod 42*b* is connected to the first elastic member 43 at its opposite end. As the first screw 42*a* is rotated in one direction, the rod 42*b* is moved inside the movable member 42.

The first elastic member 43 is connected to the armrest body 41 and the movable member 42 and applies an elastic force thereto. The first elastic member 43 may comprise a tension spring. Further, the first elastic member 43 is connected to the first rail groove 41*b* (i.e., the armrest body 41) at its one end and, at its opposite end, is connected to the opposite end of the rod 42*b*. If the rod 42*b* is moved inside the movable member 42 with screw motion due to the rotation of the first screw 42*a*, then a distance between a front end of the first rail groove 41*b* and a front end of the rod 42*b* is adjusted and a length of the first elastic member 43 is adjusted. Thus, the elastic force, which the first elastic member 43 applies to the armrest body 41 and the movable member 42, can be adjusted. Consequently, when the chair 100 is changed from the first state to second state, the elastic force applied to the backrest 30 is adjusted.

As shown in FIGS. 2 to 4, the movable member 42 has a first guide slot 44 formed at its front underside. Further, the auxiliary front leg 23 is joined, at its upper ends, to the movable member 42 through the first guide slot 44. The upper ends of the auxiliary front leg 23 are moved relative to the armrest body 41 together with the movable member 42. The upper end of the auxiliary front leg 23 is movable in both backward and forward direction along the first guide slot 44 and is rotatable relative to the movable member 42. Where the first guide slot 44 becomes longer, a movement distance of the auxiliary front leg 23 becomes longer. Thus, the user may adjust only a tilt angle of the auxiliary front leg 23 in the first state.

Figure 5:
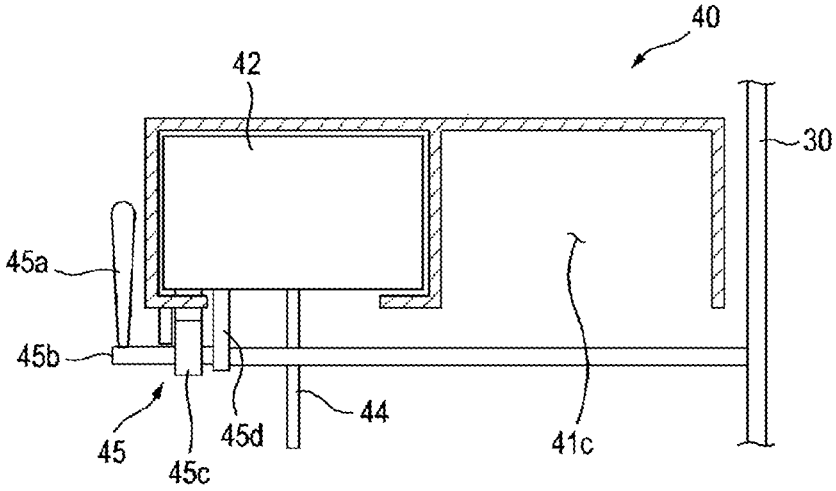
FIG. 5 is a sectional view taken along the line V-V of FIG. 3.

As shown in FIGS. 2 to 4, the armrest 40 may further include a first stopper 45. The first stopper 45 fixes the movable member 42 to the armrest body 41 in any position. Restriction of the relative movement between the movable member 42 and the armrest body 41 limits the rotation of the backrest 30. The first stopper 45 includes a lever 45*a*, a rotating shaft 45*b* and a cam element 45*c*. The lever 45*a* is coupled to one end of the rotating shaft 45*b*. As shown in FIG. 5, a first bracket 45*d*, which is disposed in the front underside of the movable member 42, rotatably supports the rotating shaft 45*b*. The cam element 45*c* is coupled to the rotating shaft 45*b*. The rotation of the lever 45*a* selectively brings the cam element 45*c* into contact with a lower portion of the first rail groove 41*b*. To increase the contact force between the cam element 45*c* and the first rail groove 41*b*, a plurality of protrusions or grooves may be formed in the lower portion of the first rail groove 41*b* in a longitudinal direction of the armrest body 41. The rotating shaft 45*b* is rotatably coupled to the lower portion of the backrest 30 at its opposite end. Thus, the approximately middle portion of the backrest 30 is moved relative to the armrest body 41 together with the movable member 42. In another embodiment, the first stopper may be disposed between the backrest 30 and the seat frame 10.

Figure 6:
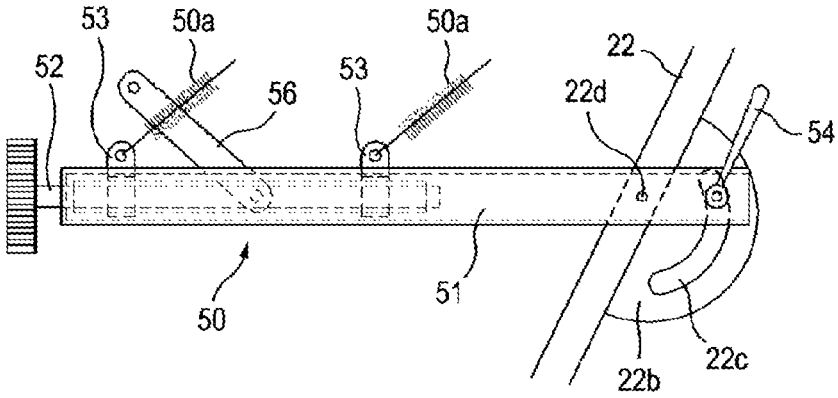
FIG. 6 is a side view showing a seat frame drive device shown in FIG. 1.

The seat frame drive device 50 rotates the seat frame 10 with respect to a plurality of the legs 20. As shown in FIG. 6, a front portion of the seat frame drive device 50 is rotatably coupled to the upper portion of the rear leg 22. The seat frame drive device 50 is joined to the armrest 40 via a second elastic member 50*a*. Specifically, the second elastic member 50*a* is connected to the underside of the armrest body 41 at its one end and to the seat frame drive device 50 at its opposite end. In the first state, the second elastic member 50*a* is extended and thus has an elastic restoration force. When the chair 100 is changed from the first state to the third state, the seat frame drive device 50 aids the first seat frame 11 to rotate with respect to the rear leg 22. Further, the seat frame drive device 50 aids the second seat frame 15 to further rotate with respect to the first seat frame 11. The seat frame drive device 50 includes a body 51, a second screw 52, a first nut 53 and a second stopper 54.

A slot 51*a* for interconnecting the first nut 53 and the second elastic member 50*a* is formed on the top of the body 51. The second screw 52 is inserted from a rear end of the body 51 towards a front end of the body 51. The seat frame drive device is configured such that the second screw 52 is not moved relative to the body 51 with screw motion and is rotated in its position. The first nut 53 is connected to a lower end of the second elastic member 50*a* and is coupled to the second screw 52 in thread engagement therewith. As the second screw 52 is rotated, the first nut 53 is moved along the slot 51*a*. The movement of the first nut 53 changes the length of the second elastic member 50*a*, thus adjusting the elastic force of the second elastic member 50*a*. The second stopper 54 is provided at the front end of the body 51, and is connected to a second bracket 22*b* formed in the upper portion of the rear leg 22. The second bracket 22*b* has a third guide slot 22*c* having a circular arc shape. The second stopper 54 is movable along the third guide slot 22*c* and fixes the seat frame drive device 50 in any position. In another embodiment, the second stopper may include a ratchet device that is provided adjacent to a third support pin 22*d*.

Figure 7:
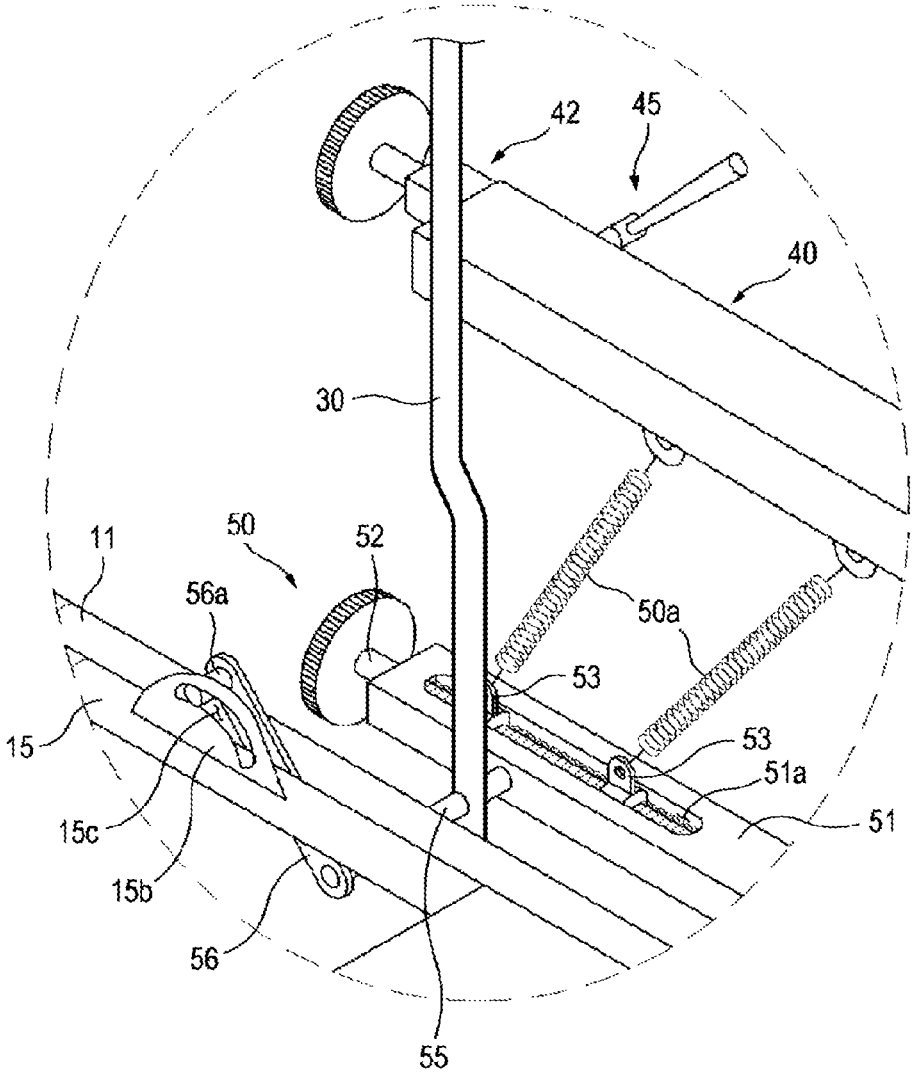
FIG. 7 is a partial perspective view showing an armrest and a seat frame drive device shown in FIG. 1.

As shown in FIG. 7, the first shaft 55 is coupled to a lateral portion of the body 51 at its one end and to an end of a link member 56 at its opposite end. The first shaft 55 is connected to the first seat frame 11, and is rotatable with respect to the first seat frame 11. The first shaft 55 rotatably supports the backrest 30. A second shaft 56*a* is coupled to the opposite end of the link member 56. The second seat frame 15 has a third bracket 15*b* connectable to the seat frame drive device 50. The third bracket 15*b* is located on the top of the second seat frame 15, and has a second guide slot 15*c* having a circular arc shape. The second shaft 56*a* is rotatable with respect to the third bracket 15*b* and is movable along the second guide slot 15*c*. As the first seat frame 11 rotates with respect to the front leg 21 and the seat frame drive device 50 rotates with respect to the rear leg 22, the first shaft 55 and the link member 56 rotate together with the seat frame drive device 50. Consequently, the second shaft 56*a* is moved along the second guide slot 15*c*, thus rotating the second seat frame 15 further than the first seat frame 11 in a clockwise direction. In another embodiment wherein the chair does not include the second seat frame, the first shaft may be directly connected to only the first seat frame.

Descriptions are made below as to the operations of the chair 100 according to an embodiment of the present invention with reference to FIGS. 8 to 10.

Figure 8:
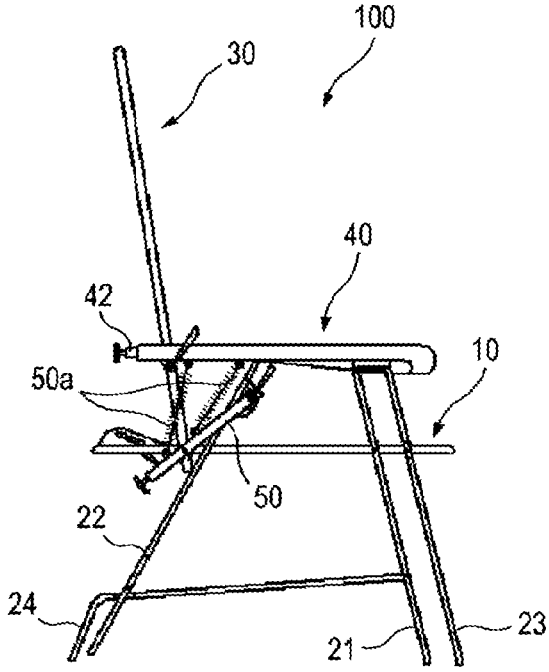
FIG. 8 is a side view showing a first state of the chair shown in FIG. 1.

The user generally uses the chair 100 in the first state shown in FIG. 8. In the first state, the user may use the chair by rotating only the auxiliary front leg 23 with respect to the first seat frame 11 in a counterclockwise direction. If the user rotates the auxiliary front leg 23 in the counterclockwise direction, then the upper end of the auxiliary front leg 23 is moved in a rearward direction along the first guide slot 44 (see FIGS. 2 and 3), and the first slide member 23*b* interconnecting the first seat frame 11 and the auxiliary front leg 23 is moved in a forward direction along the first seat frame 11. If the user rotates the auxiliary front leg 23 in the clockwise direction, then the upper end of the auxiliary front leg 23 is moved in a forward direction along the first guide slot 44 and the first slide member 23*b* is moved in a rearward direction along the first seat frame 11.

Figure 9:
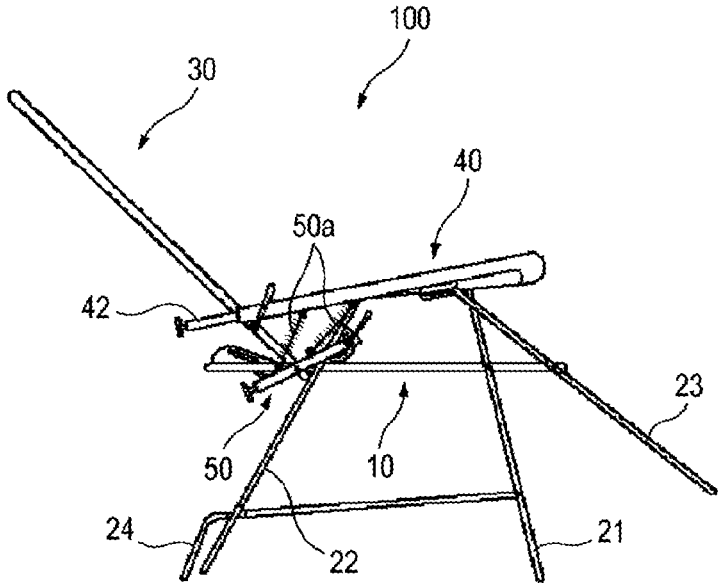
FIG. 9 is a side view showing a second state of the chair shown in FIG. 1.

As the user leans his upper body backwards, the chair 100 is changed from the first state to the second state shown in FIG. 9. If the user leans his upper body backwards, then the backrest 30 is rotated in the counterclockwise direction due to the shift in the center of gravity of the user's upper body. The rotation of the backrest 30 moves the movable member 42 in a rearward direction relative to the armrest 40 together with the first guide slot 44. The upper end of the auxiliary front leg 23 is thereby moved in a rearward direction together with the movable member 42. Thus, the auxiliary front leg 23 is rotated with respect to the first seat frame 11 in the counterclockwise direction. The first elastic member 43 (see FIG. 4) is extended by the movement of the movable member 42. Thus, the elastic restoration force is stored in the first elastic member 43.

As the user leans his upper body forward, the chair 100 is changed from the second state to the first state. If the user leans his upper body forward, then the elastic restoration force stored in the first elastic member 43 (see FIG. 4) rotates the backrest 30 in the clockwise direction. Along with the rotation of the backrest 30, the movable member 42 is moved in a forward direction relative to the armrest 40 together with the first guide slot 44. Further, the upper end of the auxiliary front leg 23 is moved in a forward direction together with the movable member 42 by the user's leg weight or the weight of the auxiliary front leg 23. Thus, the auxiliary front leg 23 is rotated with respect to the first seat frame 11 in the clockwise direction.

While the chair 100 is being changed between the first state and the second state, the first and second seat frames 11, 15, the front leg 21, the rear leg 22 and the auxiliary rear leg 24 maintain their respective positions.

Figure 10:
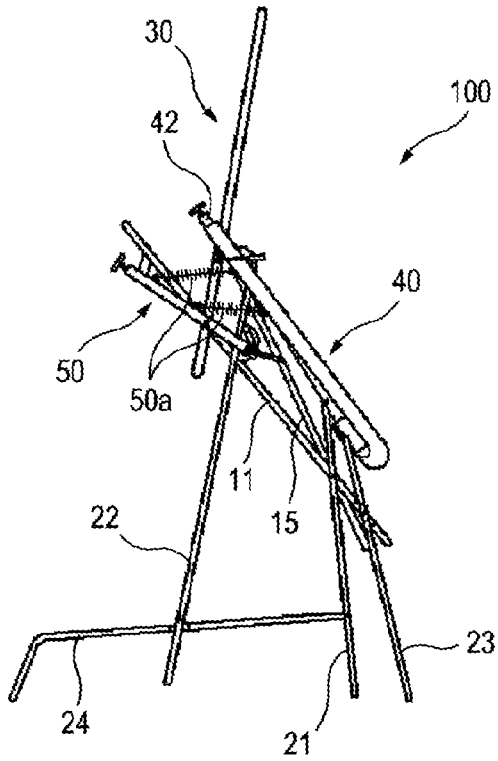
FIG. 10 is a side view showing a third state of the chair shown in FIG. 1.

As the user leans his upper body forward after unlocking the second stopper 54, the chair 100 is changed from the first state to the third state shown in FIG. 10. If the user leans his upper body forward, then the center of gravity of the user's upper body shifts toward the front of the seat frame 10. Thus, the first and second seat frames 11, 15 are rotated in the clockwise direction. The backrest 30 and the armrest 40 are rotated in the clockwise direction by the movement of the first and second seat frames 11, 15 as well as the elastic restoration force of the seat frame drive device 50. The lower portion of the rear leg 22 is moved in a forward direction along the auxiliary rear leg 24 by the rotation of the armrest 40. While the chair 100 is changed from the first state to the third state, the second seat frame 15 is rotated further than the first seat frame 11 in the clockwise direction. Specifically, the seat frame drive device 50 is rotated around the third support pin 22*d* in the clockwise direction by the rotation of the armrest 40. The first shaft 55, the link member 56 and the second shaft 56*a* are rotated by the seat frame drive device 50. Then, the second shaft 56*a* is caught in the second guide slot 15*c* provided in the second seat frame 15, thus further rotating the second seat frame 15 relative to the first seat frame 11.

If the user applies his body weight to the second seat frame 15 while sitting on the chair after stepping on the auxiliary front leg 23, the chair 100 is changed from the third state to the first state. If the user's body weight is applied to the second seat frame 15, then the second seat frame 15 is rotated in the counterclockwise direction. Due to the rotation of the second seat frame 15, the seat frame drive device 50 is rotated in the counterclockwise direction together with the first shaft 55, the link member 56 and the second shaft 56*a*. In such a process, the second seat frame 15 and the first seat frame 11 overlap each other. Further, the backrest 30 and the armrest 40 are rotated in the counterclockwise direction. The lower portion of the rear leg 22 is moved in a rearward direction along the auxiliary rear leg 24 by the rotation of the armrest 40.

As described above, the user may use the chair 100 in various forms. Further, the user can easily change the form of the chair 100 into the first to third states by shifting his body weight.

Figure 11:
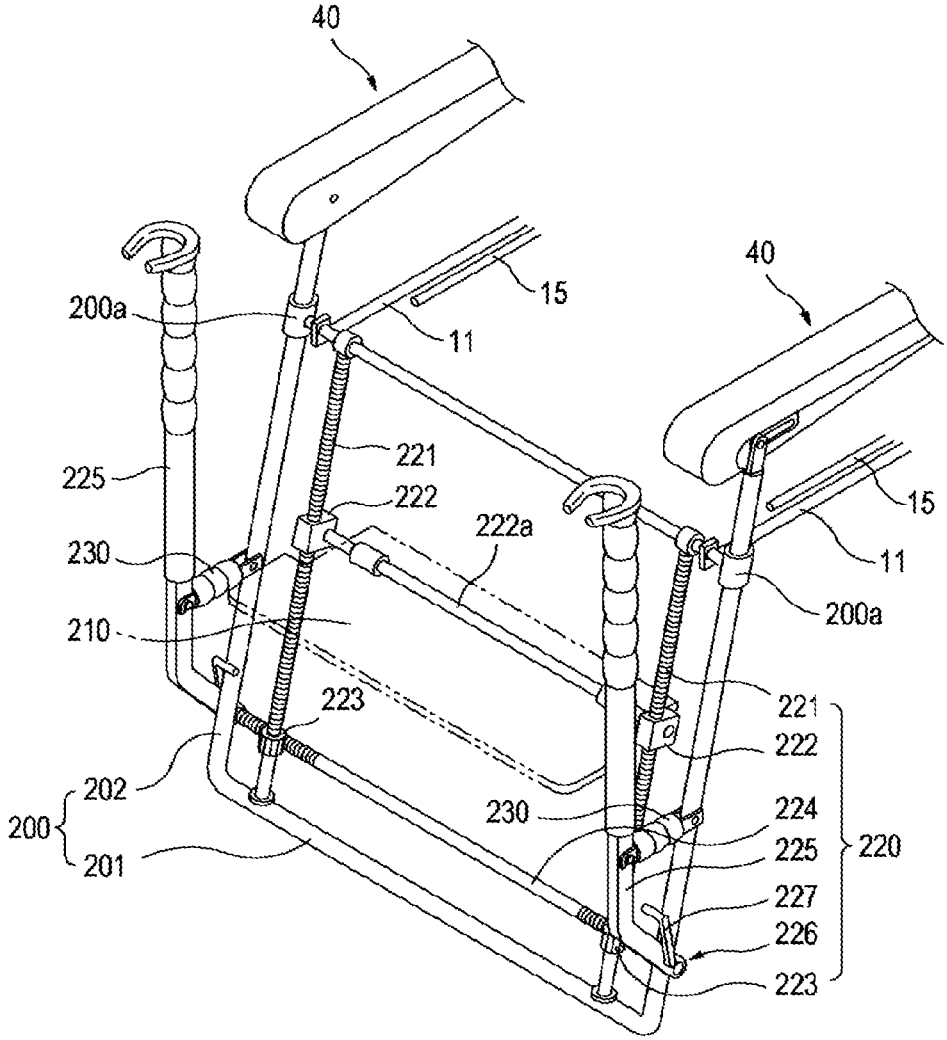
FIG. 11 is a partial perspective view showing another embodiment of an auxiliary front leg.
Figure 12:
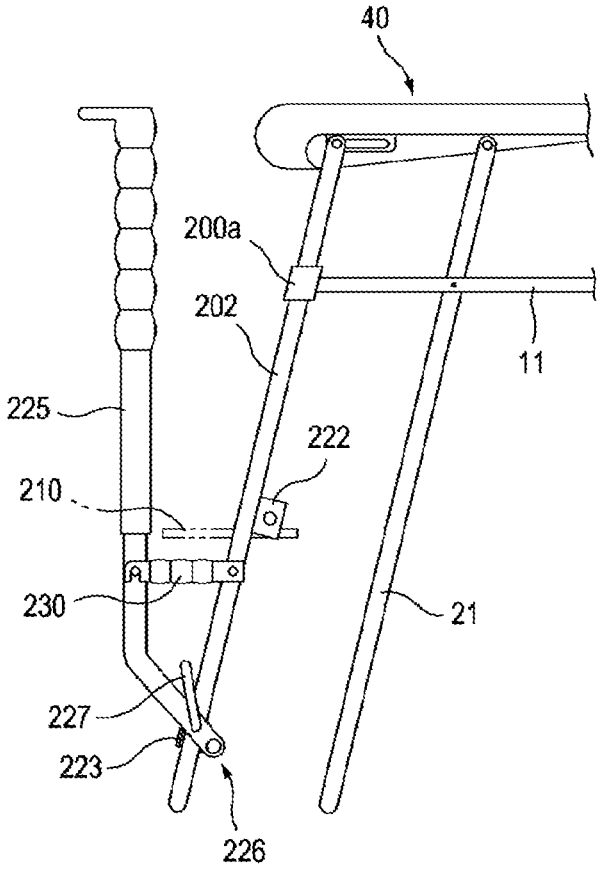
FIG. 12 is a side view of FIG. 11.

As shown in FIGS. 11 and 12, an auxiliary front leg 200 includes a horizontal bar 201 and vertical bars 202 extending from both ends of the horizontal bar 201 vertically to the horizontal bar 201. Similar to the auxiliary front leg 21 of the embodiment illustrated in FIGS. 1 to 10, upper ends of the vertical bars 202 of this embodiment are rotatably coupled to the front portions of the armrest 40 (i.e., the first guide slot 44) respectively. The vertical bar 202 is joined to the first seat frame 11 by means of a third slide member 200*a*. The third slide member 200*a* may have a hollow cylindrical shape, and is rotatably coupled to the front end of the first seat frame 11. Further, the third slide member 200*a* is slidably coupled to the upper portion of the vertical bar 202 such that it is vertically slidable along the vertical bar 202. The third slide member 200*a* may be configured to be fixed to the upper portion of the vertical bar 202 in any position. For example, the third slide member 200*a* may have a protrusion protruding inwardly with resilience and the vertical bar 202 may have, at its upper portion, a plurality of recesses which said protrusion engages.

Referring to FIGS. 11 and 12, the auxiliary front leg 200 includes an auxiliary seat 210, an elevation device 220 and an auxiliary handle 230.

The auxiliary seat 210 is rotatably coupled to the vertical bars 202. When the auxiliary seat 210 is positioned parallel to the floor, the auxiliary seat 210 serves as a seat. Similar to the cushion member 23*a* of the embodiment illustrated in FIGS. 1 to 10, the auxiliary seat 210 supports the user's legs or calves in the first state or the second state when the auxiliary seat 210 is positioned parallel to the vertical bars 202.

The elevation device 220 serves to vertically elevate or lower the auxiliary seat 210. The elevation device 220 includes a threaded shaft 221, a second nut 222, a worm wheel 223, a drive shaft 224, a worm gear 224*a*, a handle 225, a ratchet mechanism 226 and a lever 227.

The threaded shaft 221 is disposed parallel to the vertical bar 202 and is located further inside than the vertical bar 202. The threaded shaft 221 is rotatably connected to the third slide member 200*a* at its upper end and is rotatably connected to either side of the vertical bar 202 at its lower end. Another embodiment may include the threaded shaft that has a plurality rows of screw threads to facilitate the descent of the auxiliary seat. The second nut 222 is coupled to the threaded shaft 221 in thread engagement therewith and is moved with screw motion along the threaded shaft 221 by the rotation of the threaded shaft 221. Two second nuts 222 are connected to each other via a connecting shaft 222*a*. The auxiliary seat 210 is coupled to the top of the connecting shaft 222*a*. The worm wheel 223 is coupled to a lower portion of the threaded shaft 221.

The drive shaft 224 is disposed adjacent to the lower portion of the front leg 200 and is vertical to the threaded shaft 221, but parallel to the horizontal bar 201. The worm gear 224*a* is formed in the drive shaft 224 and is in mesh with the worm wheel 223. The handles 225 are coupled to both ends of the drive shaft 224 respectively. The handle 225 is reciprocatingly pivotable in both backward and forward directions around the drive shaft 224. Further, when the chair 100 is changed from the first state to the third state, the user may stand up while grasping and then leaning upon the handle 225. The ratchet mechanism 226 is disposed between the end of the drive shaft 224 and the lower end of the handle 225. The ratchet mechanism 226 includes a ratchet wheel and a claw. Further, the ratchet mechanism 226 is configured such that the ratchet wheel rotates in one direction and the claw prevents the ratchet wheel from rotating in the reverse direction. That is, the ratchet mechanism 226 rotates the drive shaft 224 in said one direction by the reciprocating pivotal movement of the handle 225. The lever 227 locks or unlocks the ratchet mechanism 226. When the lever 227 locks the ratchet mechanism 226, the user can rotate the drive shaft 224 in said one direction by reciprocatingly pivoting the handle 225. If the drive shaft 224 is rotated in said one direction, then the threaded shaft 221 is rotated in one direction through the mesh between the worm gear 224*a* and the worm wheel 223. Thus, the second nut 222 is moved upward together with the auxiliary seat 210.

When the lever 227 unlocks the ratchet mechanism 226, the worm gear 224*a* is freely rotatable in a direction opposite to the one direction. Further, the threaded shaft 221, the worm wheel 223 of which in mesh with the worm gear, is also freely rotatable in the direction opposite to the one direction. Thus, when the user sits on the auxiliary seat 210, the user can move in a downward direction while the second nut 222 rotates the threaded shaft 221 due to the user's body weight. In another embodiment, the elevation device may include a drive motor for driving the threaded shaft 221 and an operating portion for controlling the drive motor.

The auxiliary handle 230 is rotatably coupled to the lower portion of the vertical bar 202 at its one end and releasably engages the lower portion of the handle 225 at its opposite end. The auxiliary handle 230 anchors the handle 225 when the handle 225 is not used. When the auxiliary seat 210 is positioned in a low position, the user can grasp the auxiliary handle 230 and then sit on the auxiliary seat 210.

While the present invention has been described by way of the foregoing embodiments and the accompanying drawings, the present invention should not be limited thereto. It will be apparent to those of ordinary skill in the art that various substitutions, alternations and modifications may be made without departing from the scope of the present invention.

What is claimed is:

1. A chair, comprising:

a seat frame;

a plurality of legs rotatably coupled to the seat frame at a front portion and a rear portion of the seat frame;

a backrest rotatably coupled to the seat frame at the rear portion of the seat frame; and an armrest rotatably coupled to upper ends of the legs, wherein the armrest includes:

a movable member retained inside the armrest and movable along the armrest, the movable member being rotatably coupled to the backrest; and a first elastic member located inside the armrest and applying an elastic restoration force against a movement of the movable member.

2. The chair of claim 1, wherein the movable member includes a first guide slot formed in the movable member, and wherein the plurality of legs comprise:

a front leg rotatably coupled to the seat frame and the armrest;

a rear leg rotatably coupled to the armrest;

an auxiliary front leg rotatably coupled to the seat frame, the auxiliary front leg being rotatably coupled to the first guide slot at an upper end thereof; and an auxiliary rear leg rotatably coupled to the rear leg, the auxiliary rear leg being rotatably coupled to the front leg at a front end thereof.

3. The chair of claim 2, wherein the auxiliary front leg comprises: an auxiliary seat rotatable with respect to the auxiliary front leg; and an elevation device configured to elevate and lower the auxiliary seat.

4. The chair of claim 3, wherein the elevation device comprises:

a threaded shaft;

a second nut coupled in thread engagement with the threaded shaft at either side of the auxiliary seat, the second nut configured to being moved with screw motion along the threaded shaft;

a drive shaft disposed perpendicularly to the threaded shaft at a lower portion of the auxiliary front leg; and a worm wheel and a worm gear disposed between the threaded shaft and the drive shaft and being in mesh with each other.

5. The chair of claim 4, wherein the elevation device comprises a handle coupled to an end of the drive shaft via a ratchet mechanism.

6. The chair of claim 5, wherein the auxiliary front leg further comprises an auxiliary handle, the auxiliary handle being rotatably coupled to the lower portion of the auxiliary front leg at one end thereof and releasably coupled to a lower portion of the handle at an opposite end thereof.

7. The chair of claim 2, wherein the plurality of legs further comprise:

a first slide member rotatably coupled to the auxiliary front leg and backward- and forward-movably coupled to the seat frame along the seat frame; and a second slide member rotatably coupled to the auxiliary rear leg and backward- and forward-movably coupled to the auxiliary rear leg along the auxiliary rear leg.

8. The chair of claim 7, wherein the seat frame comprises:

a support pin;

a first seat frame rotatably coupled to the front leg via the support pin; and a second seat frame rotatably coupled to the front leg via the support pin, the second seat frame rotating around the support pin relative to the first seat frame.

9. The chair of claim 1, further comprising a seat frame drive device having a second elastic member, the seat frame drive device being elastically connected to the armrest via the second elastic member and rotating the seat frame with respect to the plurality of legs.

10. The chair of claim 9, wherein the seat frame further includes a second, circular arc shaped guide slot at a top thereof, and wherein the seat frame drive device includes:

a first shaft coupled to a lateral portion of the seat frame drive device at one end thereof;

a link member coupled to an opposite end of the first shaft at one end thereof; and a second shaft coupled to an opposite end of the link member at one end thereof, an opposite end of the second shaft configured to move along the second guide slot.

11. The chair of claim 9, wherein the seat frame drive device includes a second screw and a first nut coupled to the second screw in thread engagement, wherein the second elastic member is connected to the first nut at an opposite end thereof.

12. The chair of claim 1, wherein the movable member comprises:

a first screw; and a rod coupled to the first screw in thread engagement and connected to the first elastic member, wherein a rotation of the first screw moves the rod with screw motion.

* * * * *